US008413765B2

(12) United States Patent
Stratmann

(10) Patent No.: US 8,413,765 B2
(45) Date of Patent: Apr. 9, 2013

(54) ELECTRONIC SAFETY SYSTEM FOR AN ELEVATOR HAVING A BUS AND SAFETY CIRCUIT

(75) Inventor: Christoph Stratmann, Essen (DE)

(73) Assignee: K.A. Schmersal Holding GmbH & Co. KG, Wuppertal (DE)

( * ) Notice: Subject to any disclaimer, the term of this patent is extended or adjusted under 35 U.S.C. 154(b) by 319 days.

(21) Appl. No.: 12/855,986

(22) Filed: Aug. 13, 2010

(65) Prior Publication Data

US 2011/0036668 A1 Feb. 17, 2011

(30) Foreign Application Priority Data

Aug. 14, 2009 (DE) ..... 10 2009 037 347

(51) Int. Cl.
*B66B 1/28* (2006.01)

(52) U.S. Cl.
USPC ..... 187/247; 187/393

(58) Field of Classification Search ..... 187/247, 187/248, 289, 293, 296, 297, 391–393, 394
See application file for complete search history.

(56) References Cited

U.S. PATENT DOCUMENTS

| | | | | |
|---|---|---|---|---|
| 4,750,591 | A * | 6/1988 | Coste et al. | 187/391 |
| 4,785,914 | A * | 11/1988 | Blain et al. | 187/280 |
| 5,107,964 | A * | 4/1992 | Coste et al. | 187/280 |
| 6,173,814 | B1 * | 1/2001 | Herkel et al. | 187/288 |
| 6,554,107 | B2 * | 4/2003 | Yumura et al. | 187/247 |
| 7,228,943 | B2 * | 6/2007 | Kugiya et al. | 187/393 |
| 7,350,624 | B2 * | 4/2008 | Deplazes et al. | 187/393 |
| 7,493,991 | B2 * | 2/2009 | Oh et al. | 187/394 |
| 7,533,763 | B2 * | 5/2009 | Kattainen et al. | 187/394 |
| 7,849,975 | B2 * | 12/2010 | Ketonen et al. | 187/394 |
| 7,891,467 | B2 * | 2/2011 | Kattainen et al. | 187/394 |
| 8,230,977 | B2 * | 7/2012 | Thumm et al. | 187/247 |
| 2005/0098390 | A1 | 5/2005 | Angst | |
| 2009/0321192 | A1 * | 12/2009 | Kattainen et al. | 187/279 |
| 2010/0038185 | A1 * | 2/2010 | Kattainen et al. | 187/288 |
| 2011/0114422 | A1 * | 5/2011 | Kattainen et al. | 187/301 |
| 2012/0080273 | A1 * | 4/2012 | Herkel et al. | 187/247 |

FOREIGN PATENT DOCUMENTS

| | | | |
|---|---|---|---|
| DE | 19903645 | A1 | 8/2000 |
| DE | 102004009250 | A1 | 9/2005 |
| EP | 1090870 | B1 | 4/2001 |

(Continued)

OTHER PUBLICATIONS

English translation of Abstract of JP5215853 (A).

(Continued)

*Primary Examiner* — Anthony Salata
(74) *Attorney, Agent, or Firm* — Kilpatrick Townsend & Stockton LLP

(57) ABSTRACT

An electronic safety system for an elevator with a controller, which is coupled to a motor for driving an elevator car, a safety controller and a bus by means of which the controller can communicate with bus nodes which receive data from at least one sensor. The controller can communicate with a safety circuit which can be put into an open state by the safety controller, as a result of which the motor is shut off, and the safety circuit has a means which notifies the controller of shut-off of the motor, or shut-off of the motor can be detected by the controller on the basis of the data transmitted from the bus nodes to the controller.

6 Claims, 1 Drawing Sheet

FOREIGN PATENT DOCUMENTS

| | | | |
|---|---|---|---|
| EP | 1159218 | B1 | 7/2006 |
| EP | 1864935 | A1 | 12/2007 |
| WO | WO00/51929 | A1 | 9/2000 |
| WO | WO2008/081074 | A1 | 7/2008 |
| WO | WO2009/073025 | A1 | 6/2009 |
| WO | WO2010/072658 | A1 | 7/2010 |

OTHER PUBLICATIONS

English translation of Abstract of JP2006315794 (A).
English translation of Japanese Office Action for JP 2010-181050, dated Apr. 16, 2012.

* cited by examiner

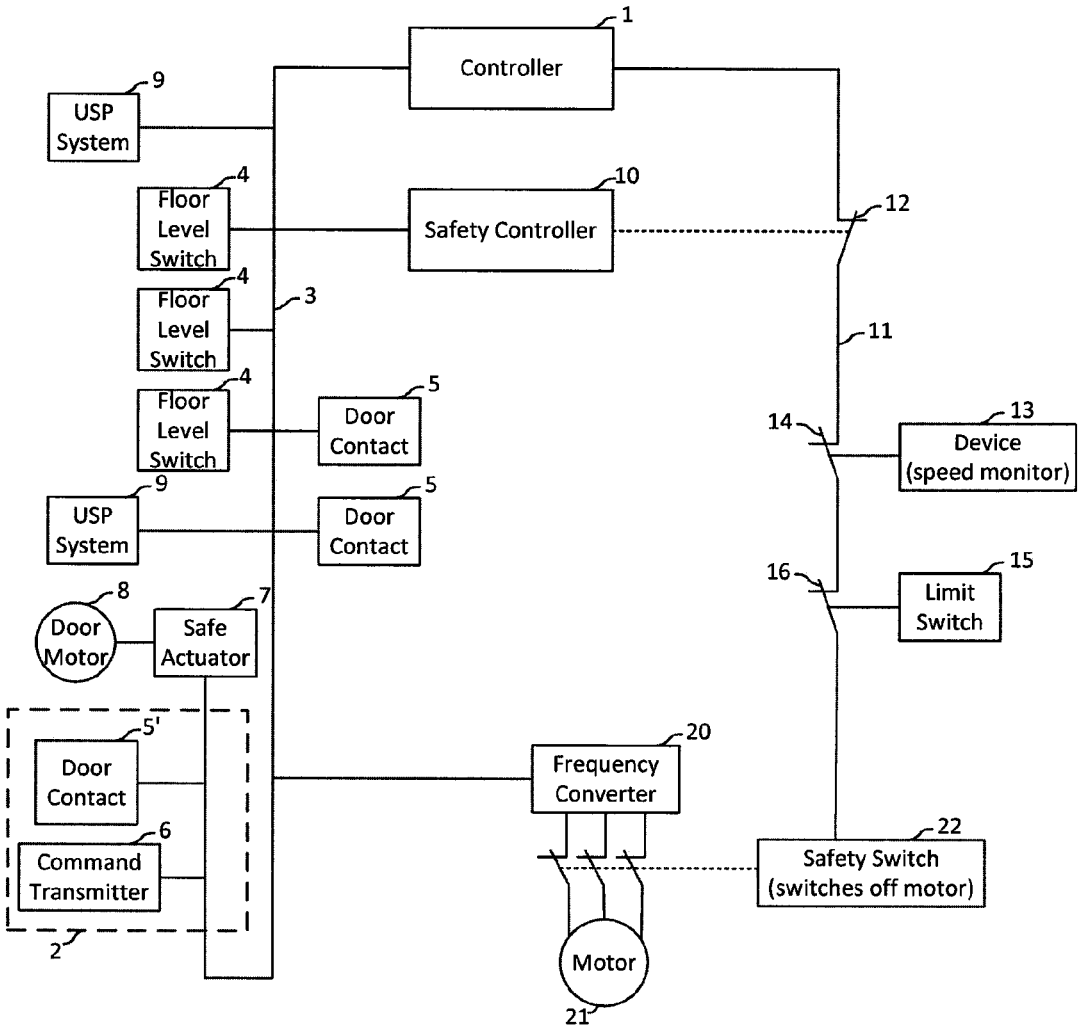
1
Controller
9
USP System
4
Floor Level Switch
10
Safety Controller
12
4
Floor Level Switch
3
11
4
Floor Level Switch
5
Door Contact
14
13
Device (speed monitor)
9
USP System
5
Door Contact
16
15
Limit Switch
8
Door Motor
7
Safe Actuator
5'
Door Contact
20
Frequency Converter
6
Command Transmitter
22
Safety Switch (switches off motor)
2
Motor
21

ELECTRONIC SAFETY SYSTEM FOR AN ELEVATOR HAVING A BUS AND SAFETY CIRCUIT

FIELD OF THE INVENTION

The invention relates to safety systems for elevators.

BACKGROUND OF THE INVENTION

EP 1 159 218 B1 discloses an electronic safety system for an elevator in which safety shut-off is performed when an unsafe state is determined. The electronic safety system comprises a safety control device and a communication bus which allows control and data signals to be interchanged between a control device based on a microprocessor and various components which comprise bus nodes. The bus nodes are in a form such that they form an interface for sensors, contacts and switches. A safety control device processes the data received from the bus nodes and determines whether there is an unsafe state. In the event of an unsafe state, the safety control device sends a stop signal to the drive and brake unit of the elevator, with a status signal which indicates the unsafe state also being sent to the control device.

In the case of the safety control device which is known from EP 1 159 218 B1, the control device of the elevator is not intended to process any information from the bus nodes, but rather the control device actually obtains the processed information from the bus nodes from the safety control device in order to allow a faster reaction by the control device of the elevator. The safety control device undertakes the safety tasks on its own and is assigned an elementary role.

BRIEF SUMMARY OF THE INVENTION

It is an object of the invention to obtain a fast and safe embodiment of an electronic safety system in which a safety component is relieved of a load, which results in access to more information and increased safety with a possible improvement in maintenance.

As a result, a safety component such as a safety controller is relieved of load by virtue of the controller of the elevator indeed not obtaining from the safety controller the notification that shut-off or transfer to a safe state is or has been performed for a possible hazard potential.

The invention is explained in more detail below with reference to the exemplary embodiments which are illustrated in the appended figures.

BRIEF DESCRIPTION OF THE DRAWING

FIG. 1 schematically shows a block diagram of the drive of an elevator car.

DETAILED DESCRIPTION OF THE INVENTION

FIG. 1 shows a block diagram of an elevator. A controller 1 is provided for a schematically shown elevator car denoted by 2.

A motor 21 for driving the elevator car 2 is coupled to a bus 3 by means of a frequency converter 20.

The controller 1 communicates via the bus 3 by means of bus nodes with components which, by way of example, are indicated as a floor level switch 4, door contact 5, command transmitter 6 and safe actuator 7 for a door motor 8 of the elevator car 2. The controller 1 receives signals from the components via the bus 3 by means of the bus nodes, which form an interface for the components, such as the request for a journey to a particular floor level via the command transmitter 6 in the elevator car 2.

In addition, signals are obtained from floor level switches 4 which allow inferences about the floor level on which the elevator car 2 is situated. The door contacts 5 provide a signal regarding whether the door of the relevant floor level is closed or open. The door contact 5' provides a signal regarding whether the door of the elevator car 2 is closed or open. The safe actuator 7 is used to drive the door motor 8 of the elevator car 2, which door motor can be controlled by the controller 1 by means of appropriate signals which are sent via the bus 3.

In addition, at least two ultrasound position systems or USP systems 9 or a two-channel USP system is/are provided which each use ultrasound to ascertain the position of the elevator car 2 in the elevator shaft. The USP systems 9 used are preferably systems from the Schmersal company, the operation of which is described in the product catalogue "Aufzugsschaltgeräte-Aufzugs-Positionssystem USP" [Elevator switchgear-elevator position system USP] dated 31 Oct. 2007. The two USP systems 9 or the one two-channel USP system allow(s) redundant ascertainment of the position, which meets stringent safety requirements by comparing the position of the elevator car 2 as ascertained by the two USP systems 9 or the position of the elevator car 2 as ascertained by the one two-channel USP system. In addition, the position of the elevator car 2 ascertained over time can be used by the two USP systems 9 or the one two-channel USP system to determine the speed of the elevator car 2 in the elevator shaft as a derivation of the local operation of the elevator car 2 in the elevator shaft on the basis of time. It goes without saying that it is also possible to use more than two USP systems 9. With two, however, the requisite redundancy is already obtained. Similarly, a two-channel USP system likewise provides the redundancy. In the case of the two-channel USP system, for example, it is possible to use a transmitter with two receivers and corresponding two channels.

The bus 3 has a safety controller 10 coupled to it as Can safety controller, which is able to receive the signals from floor level switch 4, door contact 5, 5', command transmitter 6, safe actuator 7, door motor 8 and USP system 9 via the bus 3. The floor level switch 4, door contact 5, 5', command transmitter 6, safe actuator 7 and USP system 9 can to this extent be called sensors.

The controller 1 is connected to a safety circuit 11 which the safety controller 10 can open using a (safety) switch 12. The safety controller 10 monitors the safety operation of the elevator. If the safety controller 10 determines an unsafe state, such as the fact that the door contact 5' is indicating that the door of the elevator car 2 is open while travelling between two floor levels, the (safety) switch 12 is opened and the elevator shut down or put into a safe state. Opening the safety circuit 11 results in operation of the (safety) switch 22, which switches off the motor 21.

Provision may be made for a device 13 for monitoring the speed of the elevator car 2 to be able to open a (safety) switch 14 independently of the safety controller 10 in order to open the safety circuit 11, for example when a predetermined threshold value for the speed of the elevator car 2 is exceeded. The device 13 for monitoring the speed of the elevator car 2 may be implemented independently of the USP systems 9 or by the latter.

Provision may be made for one or two limit switches 15 for monitoring the overshooting of a predetermined local position of the elevator car 2 to be able to open a (safety) switch 16 independently of the safety controller 10 in order to open the safety circuit 11, for example when the elevator car 2 in the elevator shaft exceeds a predetermined limit position at the lower or upper end of the elevator shaft. The limit switch(es) 15 may be implemented independently of the USP systems 9 or the two-channel USP system or by the latter.

When the motor 21 is shut off, the controller 1 receives from the safety circuit 11 the acknowledgement that the safety circuit 11 has been opened and the (safety) switch 22 has been operated to stop the motor 21. To this end, a means is provided which reports the open safety circuit 11 to the controller 1. This means may be implemented by the (safety) switch 22, for example. As an alternative or in addition, provision may be made for the controller 3 to evaluate the information from the components, such as floor level switch 4, door contact 5, command transmitter 6, safe actuator 7, door motor 8 and USP system 9, and to determine that shut-off needs/needed to be performed by the safety controller 10. Provision may also be made for the safety controller 10 to forward the signals received from the components to the controller 1.

The controller 1 can evaluate signals from the individual components connected to the bus nodes in order to provide an improved diagnosis and maintenance opportunity.

By way of example, the safety controller 10 can ascertain the position of the elevator car 2 in the elevator shaft redundantly by virtue of the two USP systems 9 connected to the bus 3 or by virtue of the one two-channel USP system.

If a floor level door of the elevator shaft now does not close correctly and the door contact 5 is not closed, it is possible to move the elevator car 2 above or below the impaired door whose door contact 5 is not closed. The redundancy of the position-finding for the elevator car 2 by the two USP systems 9 or the one two-channel USP system is taken as safe information for which the elevator is not shut off while the elevator car 2 does not enter the floor level region with the impaired door, i.e. the open door contact 5. The availability of the elevator is improved.

In addition, provision may be made for a speed information item for the elevator car 2 to be able to be determined by the safety controller 10 from the two USP systems 9 or the one two-channel USP system redundantly so that it is possible to "catch up" in the region of the door zones of the elevator car 2, i.e. the safety controller 10 provides the safe actuator 7 on the elevator car 2 with an enable signal in the region of the door zones so that the door motor 8 can be operated in the region of the door zone. This allows the operation of the door zone monitoring to be integrated in the safety controller 10.

The invention claimed is:

1. Electronic safety system for an elevator with a controller which is coupled to a motor for driving an elevator car, comprising a safety controller and a bus by means of which the controller communicates with bus nodes which receive data from at least one sensor, wherein the controller communicates with a safety circuit which is placed into an open state by the safety controller upon receipt of data from the at least one sensor indicating an unsafe state, as a result of which the motor is shut off, and the safety circuit has a means which notifies the controller of shut-off of the motor, or shut-off of the motor can be detected by the controller on the basis of the data transmitted from the bus nodes to the controller, and wherein the safety circuit further comprises one or more switches that are openable independently of the controller.

2. Electronic safety system according to claim 1, wherein the sensor provided is at least two USP systems which can be used to redundantly perform position-finding for the elevator car.

3. Electronic safety system according to claim 1, wherein a safe actuator is provided, to which it is possible to transmit an enable signal for driving a door motor of the elevator car when at least two USP systems as sensors are used to establish a position of the elevator car and a predetermined speed of the elevator car is not being exceeded.

4. Electronic safety system according to claim 1, wherein the one or more switches that are openable independently of the controller comprises a safety switch that is openable by a device for monitoring a speed of the elevator car.

5. Electronic safety system according to claim 1, wherein the one or more switches that can be opened independently of the controller comprises a safety switch that is openable by a device configured to monitor an overshooting of a predetermined position of the elevator car.

6. Electronic safety system for an elevator with a controller which is coupled to a motor for driving an elevator car, comprising a safety controller and a bus by means of which the controller communicates with bus nodes which receive data from at least one sensor, wherein the controller communicates with a safety circuit which is placed into an open state by the safety controller upon receipt of data from the at least one sensor indicating an unsafe state, as a result of which the motor is shut off, and the safety circuit has a means which notifies the controller of shut-off of the motor, and wherein the safety circuit further comprises one or more switches that can be opened independently of the controller.

* * * * *